US008453998B2

(12) United States Patent
Pattullo et al.

(10) Patent No.: US 8,453,998 B2
(45) Date of Patent: Jun. 4, 2013

(54) AIR SCAVENGING CARBURETOR

(75) Inventors: George M. Pattullo, Caro, MI (US); Thomas L. Schmidt, Cass City, MI (US); David L. Thomas, Cass City, MI (US)

(73) Assignee: Walbro Engine Management, L.L.C., Tucson, AZ (US)

( * ) Notice: Subject to any disclaimer, the term of this patent is extended or adjusted under 35 U.S.C. 154(b) by 344 days.

(21) Appl. No.: 12/858,116

(22) Filed: Aug. 17, 2010

(65) Prior Publication Data

US 2012/0043674 A1 Feb. 23, 2012

(51) Int. Cl.
*F02M 23/03* (2006.01)

(52) U.S. Cl.
USPC ..... 261/23.2; 261/23.3; 261/46; 261/47; 261/DIG. 1

(58) Field of Classification Search
USPC ..... 261/23.2, 23.3, 46, 47, DIG. 1
See application file for complete search history.

(56) References Cited

U.S. PATENT DOCUMENTS

| | | | | |
|---|---|---|---|---|
| 3,439,658 | A * | 4/1969 | Simonet | 123/277 |
| 3,941,105 | A * | 3/1976 | Yagi et al. | 123/274 |
| 3,967,600 | A * | 7/1976 | Iiyama et al. | 261/23.2 |
| 4,026,280 | A * | 5/1977 | Iiyama et al. | 261/23.2 |
| 4,060,062 | A * | 11/1977 | Tsutsui et al. | 261/23.3 |
| 4,073,278 | A * | 2/1978 | Glenn | 123/198 F |
| 4,333,429 | A * | 6/1982 | Iiyama et al. | 123/274 |
| 5,036,816 | A * | 8/1991 | Mann | 123/361 |
| 6,347,787 | B1 * | 2/2002 | Tobinai et al. | 261/23.3 |
| 6,349,925 | B1 * | 2/2002 | Tobinai et al. | 261/23.3 |
| 6,688,585 | B2 | 2/2004 | Braun et al. | |
| 6,877,723 | B2 * | 4/2005 | Martinsson et al. | 261/23.3 |
| 6,928,996 | B2 * | 8/2005 | Tobinai | 123/586 |
| 7,334,551 | B2 | 2/2008 | Pattullo | |
| 7,429,033 | B2 * | 9/2008 | Seki et al. | 261/45 |
| 2004/0130039 | A1 * | 7/2004 | Suzuki et al. | 261/23.2 |

FOREIGN PATENT DOCUMENTS

| | | | | |
|---|---|---|---|---|
| JP | 58-72661 | A * | 4/1983 | 261/23.3 |

* cited by examiner

*Primary Examiner* — Richard L Chiesa
(74) *Attorney, Agent, or Firm* — Reising Ethington P.C.

(57) ABSTRACT

In one form, a carburetor may include an air passage, a fuel and air mixing passage, a throttle valve, an air valve and a lost motion coupler interconnecting the air valve and the throttle valve. The throttle valve may be disposed in communication with the fuel and air mixing passage and moveable between an idle position and an open position permitting an at least somewhat less restricted fluid flow therethrough than when the throttle valve is in the idle position. The air valve may be disposed in communication with the air passage, and moveable between closed and fully open positions to control air flow through the air passage. The lost motion coupler may permit a limited movement of the throttle valve away from its idle position without a corresponding movement of the air valve, and may also permit movement of the air valve along with the throttle valve after said limited movement and until the air valve is fully open, and may also permit further movement of the throttle valve to its wide open position after the air valve is fully open.

22 Claims, 7 Drawing Sheets

AIR SCAVENGING CARBURETOR

TECHNICAL FIELD

The present disclosure relates generally to a charge forming device, such as a carburetor, for controlling delivery of fuel and air to an engine.

BACKGROUND

In a 2-stroke engine, stratified scavenging arrangements have been used to reduce or prevent the blow-through or loss of fuel through exhaust ports at the time of a fuel and air mixture entering the combustion chamber. Some such arrangements use an air passage that is separate from a fuel and air mixture passage, to provide a separate flow of air to the engine.

SUMMARY

In one form, a carburetor may include an air passage, a fuel and air mixing passage, a throttle valve, an air valve and a lost motion coupler interconnecting the air valve and the throttle valve. The throttle valve may be disposed in communication with the fuel and air mixing passage and moveable between an idle position and an open position permitting an at least somewhat less restricted fluid flow therethrough than when the throttle valve is in the idle position. The air valve may be disposed in communication with the air passage, and moveable between closed and fully open positions to control air flow through the air passage. The lost motion coupler may permit a limited movement of the throttle valve away from its idle position without a corresponding movement of the air valve, and may also permit movement of the air valve along with the throttle valve after said limited movement and until the air valve is fully open, and may also permit further movement of the throttle valve to its wide open position after the air valve is fully open.

In one implementation, a carburetor may include an air passage, a fuel and air mixing passage, a throttle valve, an air valve, a choke valve and a lost motion coupler interconnecting the air valve and the throttle valve. The throttle valve may be disposed in communication with the fuel and air mixing passage and moveable between an idle position and an open position permitting an at least somewhat less restricted fluid flow therethrough than when the throttle valve is in the idle position. The air valve may be disposed in communication with the air passage, and moveable between closed, rest and fully open positions to control air flow through the air passage, wherein the rest position of the air valve is between its closed and fully open positions. The choke valve may be disposed in communication with the fuel and air mixing passage and moveable between an open position and a closed position. And the lost motion coupler may permit limited relative movement between the throttle valve and the air valve. The choke valve may engage the air valve when the choke valve is moved to its closed position to move the air valve from its rest position to its fully closed position, and the choke valve may also engage the throttle valve when the choke valve is moved to its closed position to move the throttle valve from its idle position toward its wide open position to facilitate starting an engine with which the carburetor is used. The lost motion coupler permits the movements of the throttle valve and air valve.

BRIEF DESCRIPTION OF THE DRAWINGS

The following detailed description of preferred embodiments and best mode will be set forth with reference to the accompanying drawings, in which.

DETAILED DESCRIPTION OF THE PREFERRED EMBODIMENTS

Figure 1A:
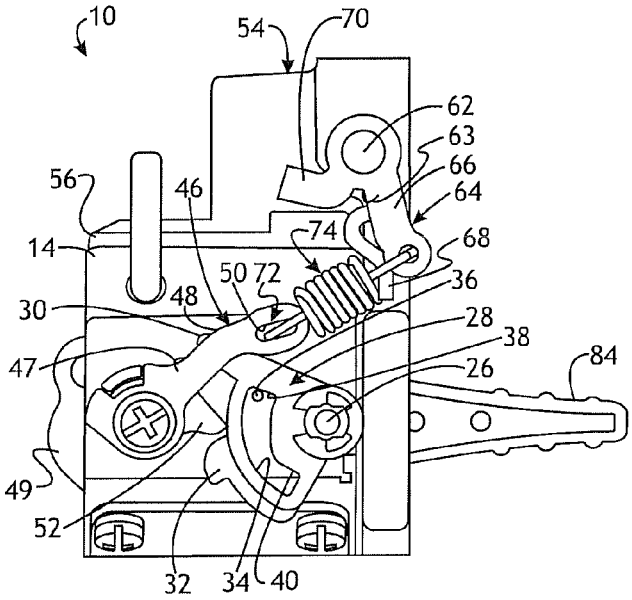
FIG. 1A is a side view of one implementation of a carburetor showing throttle, choke and air valves in their position when an engine with which the carburetor used is at idle.
Figure 1B:
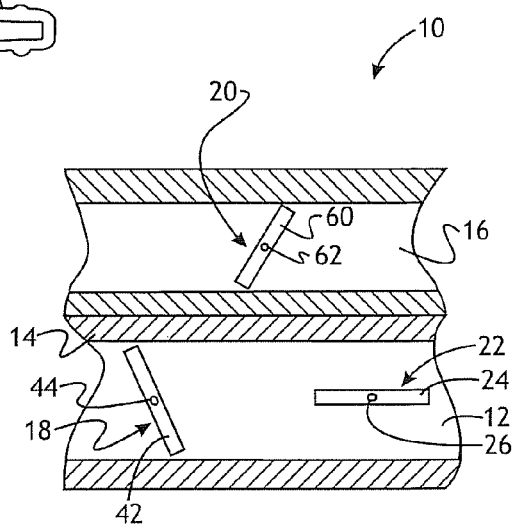
FIG. 1B is a diagrammatic view of an air passage and a fuel and air mixing passage, and the throttle, choke and air valves shown in the same position as in FIG. 1A.
Figure 4:
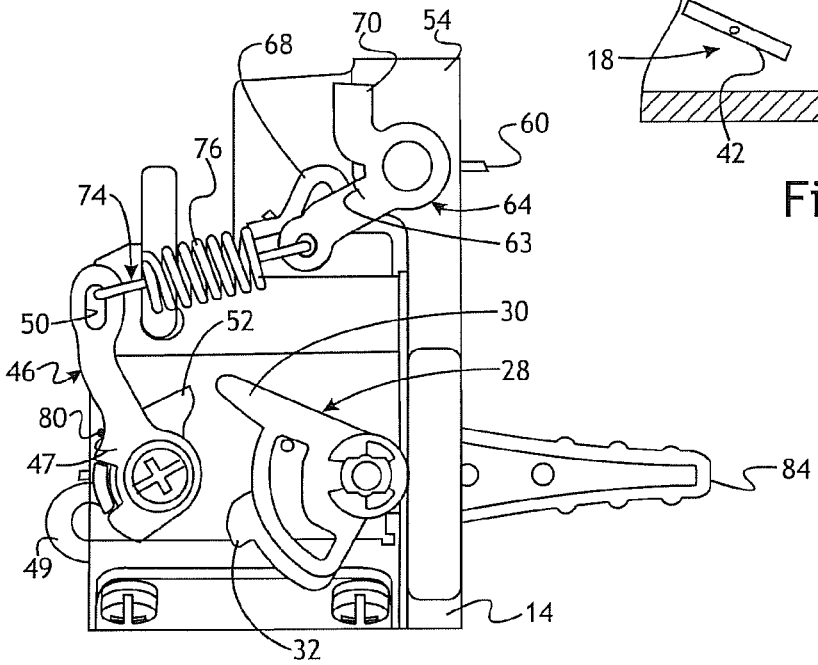
FIG. 4 is a side view of the carburetor showing the position of the throttle, choke and air valves when the throttle valve has been rotated to its wide open position.

Referring in more detail to the drawings, FIGS. 1A and 1B illustrate one presently preferred embodiment of a carburetor 10 that includes a fuel and air mixing passage 12 (FIGS. 4-6) and an air passage 16 extending through a body 14 (or more than one body, for example, the air passage 16 may be provided in a different body than the fuel and air mixing passage 12). A fuel and air mixture is supplied from the mixing passage 12 to an engine to support engine operation and air is supplied from the air passage 16 to the engine. The carburetor 10 may be a diaphragm-type carburetor having a fuel pump diaphragm (not shown) to help move fuel into and through the carburetor and a fuel metering diaphragm (not shown) that may be atmospheric referenced and controls the availability of fuel to the fuel and air mixing passage 12. Diaphragm-type carburetors of this general operating scheme are known, and U.S. Pat. No. 6,688,585 which is incorporated herein by reference in its entirety, is one example. A throttle valve 18 may be disposed in or adjacent to the mixing passage 12 to control fluid flow therethrough and an air valve 20 may be disposed in or adjacent to the air passage to control air flow therethrough. The air valve 20 is operably associated with the throttle valve 18 to control the relative movement of the valves and accordingly, the fluid flow through the air passage 16 and the fuel and air mixing passage 12.

The carburetor 10 may also have a choke valve 22 that may be disposed at least in part in or adjacent to the mixing passage 12 to facilitate starting and warming up an engine with which the carburetor is used. The choke valve 22 may include a valve head 24 rotatably supported on a valve shaft 26 for rotation between open and closed positions. The choke valve 22 may be a butterfly-type valve in which case, the choke valve head 24 is a thin, flat plate shaped complementarily to the adjacent portion of the mixing passage 12, or otherwise, as desired for a particular application. In its open position the choke valve 22 permits a relatively unrestricted flow of air past the valve head 24 within the fuel and air mixing passage 12, and in its closed position the choke valve 22 permits a restricted flow of air therethrough. A return spring (not shown) yieldably biases the choke valve 22 to its open position and may be wound on or disposed around part of the choke valve shaft 26.

A choke valve operating link 28 may be connected to one end of the choke valve shaft 26, to interact with links associated with the air valve and throttle valve, as will be described in more detail. In this regard, the choke operating link 28 may include a first projection 30 and a second projection 32. The choke valve operating link 28 and/or the carburetor body 14 may also include a position retaining feature to releasably retain the choke valve 22 in one or more positions. In the implementation shown, the choke valve link 28 includes a slot 34 or cavity providing surfaces engageable by a pin 36 carried by the body 14. As shown in FIG. 1, a stop surface 38 may engage the pin 36 to define the open position of the choke valve 22. As shown in FIG. 6A, an angled surface 40 may engage the pin 36 to releasably retain the choke valve in its closed or other position used to facilitate starting of an engine. Rather than a slot and pin, a ball and detents or other arrangement may be used to limit movement of the choke valve 22 or releasably retain the choke valve in any number of desired positions.

The throttle valve 18 may also be a butterfly-type valve with a thin, flat valve head 42 carried by a throttle valve shaft 44 that extends through and is rotatably carried by the carburetor body 14. In its idle position, the throttle valve 18 substantially restricts fluid flow through the mixing passage 12, and in its wide open position, the throttle valve 18 permits a substantially unrestricted fuel flow through the mixing passage 12.

Figure 10:
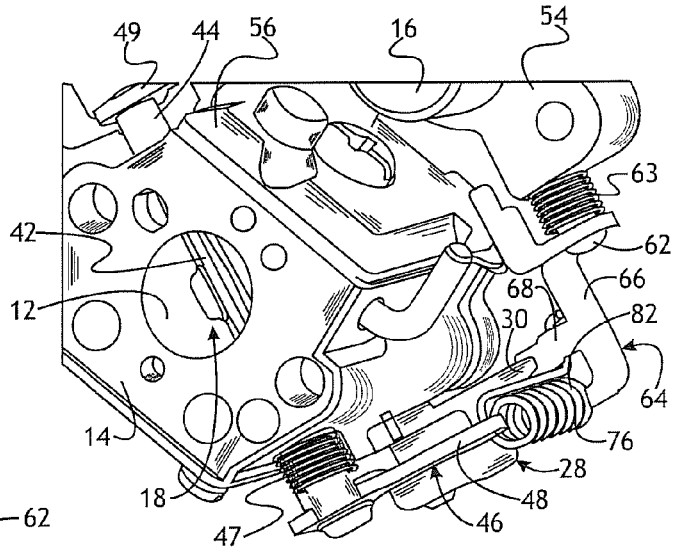
FIG. 10 is a perspective side view of the carburetor showing the position of the throttle, choke and air valves in the same position as shown in FIG. 9, and also showing a limiter coupling the throttle valve and the air valve.
Figure 12:
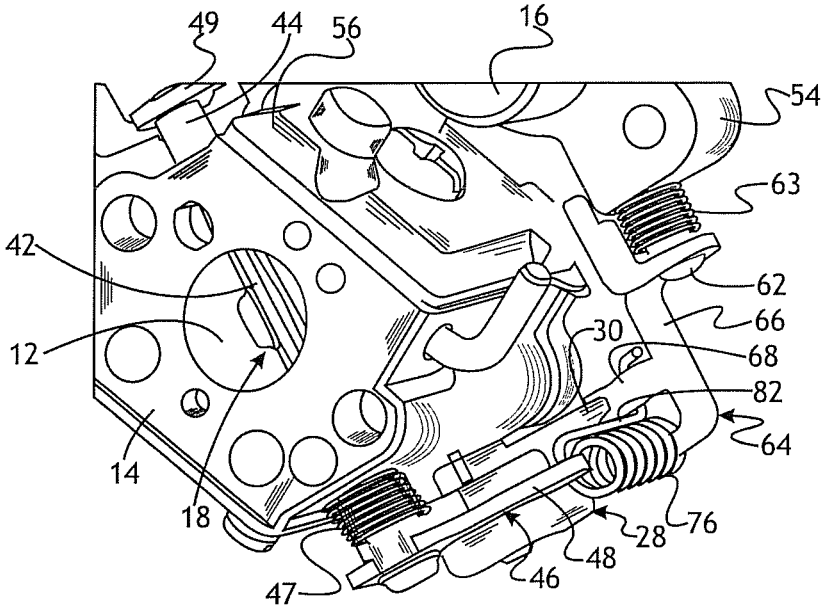
FIG. 12 is a perspective side view of the carburetor showing the position of the throttle, choke and air valves in the same position as shown in FIG. 11.

A throttle valve link 46 may be fixed to or carried by one end of the throttle valve shaft 44 for rotation in unison therewith in at least certain operating conditions. The throttle valve link 46 may be formed as one piece or more than one piece. A return spring 47 as best shown in FIGS. 10 and 12, yieldably biases the throttle valve 18 toward its idle position and may be wound on or disposed around the throttle valve shaft 44, or otherwise associated with the throttle valve. One end of the return spring may be fastened to or abuts the carburetor body 14 and the other end of the return spring may be fastened to or abuts the throttle valve link 46. The throttle valve link 46, or a different link 49 connected to the throttle valve shaft 44, may be connected to a control cable or other device (not shown) actuated and controlled by an operator of a device or engine with which the carburetor is used, so that the operator may control the movement of the throttle valve between its idle and WOT positions. The throttle valve link 46 also may include an arm 48 with an opening 50 therethrough. The opening 50 may be an elongated slot, or have any desired size or shape. The throttle valve link 46 may also include a second arm 52 that may be formed in one-piece with the rest of the throttle valve link, or separately therefrom. In the versions shown in the drawings, the second arm 52 is formed separately from the remainder of the throttle valve link 46 so different second arm designs can be used with a given throttle valve link, and vice versa. The second arm 52 is engaged by the choke valve operating link 28 during actuation of the choke valve 22, as will be discussed herein, and second arms with different shapes, sizes or orientations will interact with the choke valve differently, and that interaction can be tuned or selected for any particular application.

A scavenging air body 54 for supplying scavenging air from an air cleaner or filter (not shown) to a scavenging passage of the engine via the air passage 16 may be formed as part of or is carried by one or both of the carburetor body 16 or a mounting plate 56 or other body secured to the carburetor body 14. The air passage 16 may be approximately parallel to the fuel and air mixing passage 12, and is provided at least in part in the scavenging air body 54.

The air valve 20 may include a valve head 60 which may be a thin, flat plate that is carried by an air valve shaft 62 that is in turn rotatably carried by the carburetor body 14, and in the described embodiment, is carried by the scavenging air body 54. The air valve 20 is moveable between a fully open position permitting a substantially unrestricted flow of air through the air passage 16 and a closed position restricting air flow through the air passage 16. In the implementation shown, the air valve 20 may rotate from its closed to its open position in a direction that is opposite to the direction in which the throttle valve 18 rotates from its idle to its wide open position. The valves could also rotate in the same direction, if desired.

An air valve link 64 may be fixed to or carried by one end of the air valve shaft 62 for rotation therewith, as shown in FIG. 1, and a return spring 63 (best shown in FIGS. 10 and 12) that yieldably biases the air valve 20 toward its closed position may be wound on the air valve shaft 62 or otherwise associated with the air valve. One end of the return spring may be fastened to or abut the scavenging air body 54 and the other end of the return spring may be fastened to or abuts the air valve link 64. The link 64 may include a first arm 66 extending outwardly from the air valve shaft 62, and an extension or tab 68 that may be adjacent to the first arm 66. A second arm 70 may function as a stop for the air valve 20 to limit its rotation toward its fully open position. The second arm 70 may engage a portion of the body 14, or some other limiter.

The air valve 20 is operably connected to the throttle valve 18 by one or more lost motion couplers that permit relative rotation between the air valve and the throttle valve, in at least certain situations. A first coupler 72 may be defined by the slot 50 formed in the throttle valve link 46, and a connector 74 associated with the slot 50 that interconnects the throttle valve link 46 and the air valve link 64. The slot 50 defines a range of movement of the throttle valve 18 wherein the link 46 does not engage the connector 74 and the connector 74 does not provide a significant force on or move the air valve link 64. When the throttle valve link 46 is rotated so that an end of the slot 50 engages the connector 74 and displaces or provides a force on the connector, then, upon further rotation of the throttle valve link 46, the connector 74 provides a force on the air valve link 64 and rotates the air valve 20 upon further rotation of the throttle valve 18. In the implementation shown in FIGS. 1-12, this permits the throttle valve 18 to rotate away from its idle position a certain amount without rotating the air valve 20 from its closed position. This prevents additional air from being supplied to the engine during low speed/low load engine operation via the air passage 16, to prevent undesirably enleaning the fuel-to-air mixture ratio. As shown, for example, in FIGS. 3A and 4, the connector 74 is engaged with both the throttle valve link 46 and the air valve link 64 when the throttle valve 18 is rotated sufficiently off idle and to its wide open position.

Instead of a slot 50, a different lost motion coupling feature could be used. For example, a tether that has slack when the throttle valve 18 is in its idle position could be connected at one end to the throttle valve link 46 and at its other end to the connector 74. In such an arrangement, the slack in the tether would be taken up by rotation of the throttle valve 18 sufficiently away from idle, and then the tether would provide a force on the connector 74 to cause rotation of the air valve 20 upon further throttle valve rotation. Of course, still other examples of lost motion couplings could be used.

A second lost motion coupler may be defined by the connector 74. In the implementation shown, the connector includes or is defined by a spring 76. The spring 76 preferably is stiff enough to provide a desired rotation of the air valve 20 as the throttle valve 18 rotates through at least a certain portion of the throttle valve total range of rotation. In one form, the spring 76 is a coil spring that may be stiff enough so that the air valve 20 co-rotates with the throttle valve 18 during at least a portion of the throttle valve movement. That is, the spring 76 is not stretched, or is not significantly stretched, during a portion of the throttle valve movement and provides a substantially firm connection between the valves 18, 20 so that each unit or rotation of the throttle valve 18 causes a corresponding rotation of the air valve 20. However, during a portion of the throttle valve movement, movement of the air valve 20 may be restricted or prevented. In that case, the throttle valve 18 may continue to rotate toward its WOT position by stretching the spring 76, thereby providing further relative movement between the throttle valve 18 and the air valve 20. This may be desirable, for example, in a system wherein the air valve 20 reaches its fully open position before the throttle valve 18 reaches its WOT position. Instead of a coil spring 76, an elastic tether or band could be used, or any other suitable arrangement that permits the relative movement between the throttle valve 18 and air valve 20 as discussed herein.

Figure 2:
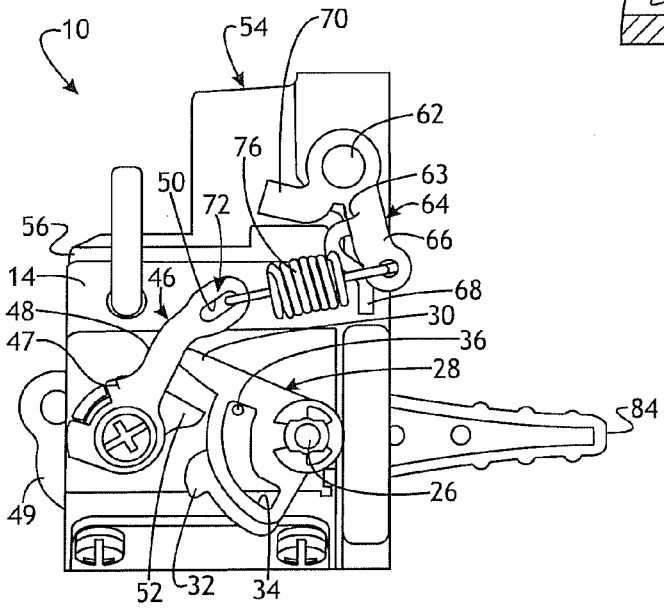
FIG. 2 is a side view of the carburetor showing the position of the throttle, choke and air valves when the throttle valve has been rotated a first distance from its idle position.
Figure 3A:
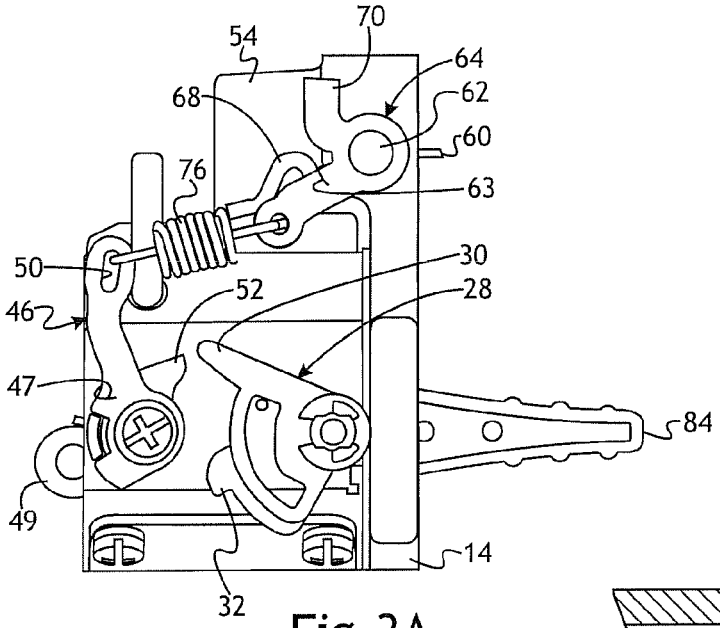
FIG. 3A is a side view of the carburetor showing the position of the throttle, choke and air valves when the throttle valve has been rotated away from idle and the air valve is fully open.
Figure 3B:
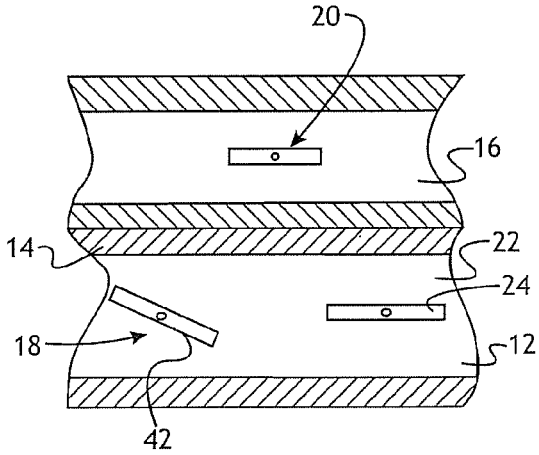
FIG. 3B is a diagrammatic view of the air passage and the fuel and air mixing passage, and the throttle, choke and air valves shown in the same position as in FIG. 3A.

As best shown in FIG. 1, when the throttle valve 18 is in its idle position the air valve 20 is closed. Initial movement of the throttle valve 18 away from its idle position causes movement of the throttle valve link 46 relative to the connector 74, but does not actuate the connector 74 so the air valve 20 does not move. Accordingly, through this lost motion coupling, the air valve 20 is held in its closed position (by the force of the return spring acting on the air valve) while the throttle valve 18 is rotated a predetermined amount from its idle position toward its wide open position. As shown in FIG. 2, when the throttle valve 18 is rotated beyond the predetermined amount, the throttle valve link 46 engages the connector 74 so that further rotation of the throttle valve 18 provides a force on the connector 74. The connector 74, in turn, provides a force on the air valve link 64 and causes the air valve 20 to rotate away from its closed position and in phased relationship with further opening of the throttle valve 18. As shown in FIG. 3, the air valve 20 may reach its fully open position before the throttle valve 18 reaches its wide open position. Further movement of the air valve 20 may be inhibited or prevented by engagement of the second arm 70 with the body 14 or another limiter.

After the air valve 20 reaches its fully open position, further movement of the throttle valve 18 toward WOT, without a corresponding movement of the air valve 20 is permitted by the connector 74. In the implementation shown in FIG. 4, the spring 76 permits this relative movement of the throttle valve 18 by extending or stretching under the force applied to the throttle valve 18 to rotate it. The WOT position of the throttle valve 18 can be controlled by a positive stop, that is, the physical engagement of one component with another component. For example, the throttle valve link 46 may engage a stop 80 (FIG. 4) carried by or formed on the body 14, or a component carried by the body 14. Or, a limiter 82 (FIGS. 10 and 12), such as a tether or other generally inextensible member, may interconnect the throttle valve 18 and air valve 20 (such as by being connected to both links) to limit the maximum distance between the two points of connection of the limiter 82 to the valves 18, 20. That way, when the air valve 20 is stopped from further movement, the throttle valve 18 can only move a predetermined amount further, as controlled by the limiter 82.

In the implementation shown, the connector includes a limiter 82 of a predetermined length that is coupled to the throttle valve link 46 and the air valve link 64 to limit the maximum separation between the points of connection of the limiter 82 to these components 46, 64. In the implementation shown, the limiter 82 is defined by a leg that may be formed in one-piece with the connector 74, and may extend from the slot 50 in the throttle valve link 46 and be hooked behind the tab 68 of the air valve link 64. In this way, the limiter 82 engages the tab 68 when the throttle valve 18 is in its wide open position. Because the tab 68 is held against movement (via engagement of the air valve link arm 70 with the body 14), the limiter 82 prevents or inhibits further movement of the throttle valve 18 (and thereby also limits the maximum extension of the connector 74). Of course, any other positive stop may be used, including engagement of a link associated with the throttle valve 18 with a portion of the body 14 or other component, or a tether not formed in one piece with the connector 74 (e.g. a cord connected to the valves that is taut only when the throttle valve is wide open). Accordingly, a positive stop can be provided for both the air valve 20 and the throttle valve 18 to more precisely control or define their fully open positions. In the implementation shown, the throttle valve stop is associated with the air valve 20 and acts, via the limiter 82, on the air valve 20. That is, the limiter 82 positively controls the wide open position of the throttle valve 18 as a function of the fully open position of the air valve 20.

When the throttle valve 18 rotates back toward its idle position, the connector 74 will be under tension until the throttle valve 18 reaches the point in its rotation that corresponds to the fully open position of the air valve 20. The air valve 20 will be held in its fully open position by the connector 74. Further movement of the throttle valve 18 toward its idle position will relieve the tension on the connector 74 and the air valve 20 will be able to rotate back toward its start position under the force of its return spring 63, and as controlled by the connector 74. The connector 74 preferably provides a greater force on the air valve 20 than does the air valve return spring 63, so that the return spring does not stretch or extend the connector 74 and the air valve 20 rotates with the throttle valve 18.

In the preferred embodiment, both the air valve 20 and throttle valve 18 rotate approximately 70 to 90 degrees and preferably about 75° from their start and idle positions to their fully and wide open positions. Preferably, the air valve 20 and throttle valve 18 rotate about the same number of degrees between their start or idle and fully open positions. Since the air valve 20 is closed or in its start position during a first portion of the throttle valve movement, the air valve 20 must rotate at a faster rate than the throttle valve 18 during at least a portion of the air valve 20 rotation so that the valves 18, 20 reach their fully and wide open positions at generally the same time. This can be controlled by choosing appropriate radial lengths and orientations of the points of connection of the connector 74 to the throttle valve link 46 and air valve link 64.

The desired extent of the lost motion coupling between the throttle valve 18 and the air valve 20 can be different depending on the engine or application. Generally, it is desirable to permit the throttle valve 18 to move away from its idle position a certain amount to a partially open off idle position while maintaining the air valve 20 closed to prevent supplying too much air and hence, an undesirably lean fuel and air mixture to the engine during certain low speed and/or low power engine operating conditions and/or starting of the engine. In one presently preferred embodiment, the air valve 20 is held in its closed position until the throttle valve 18 is rotated about 10° to 40°, and in one embodiment about 30° open away from its idle position to a partially open off idle position of the throttle valve 18. With further opening rotation of the throttle valve 18 from its off idle position, the air valve 20 opens to provide air through the air passage 16 to the engine.

Figure 5:
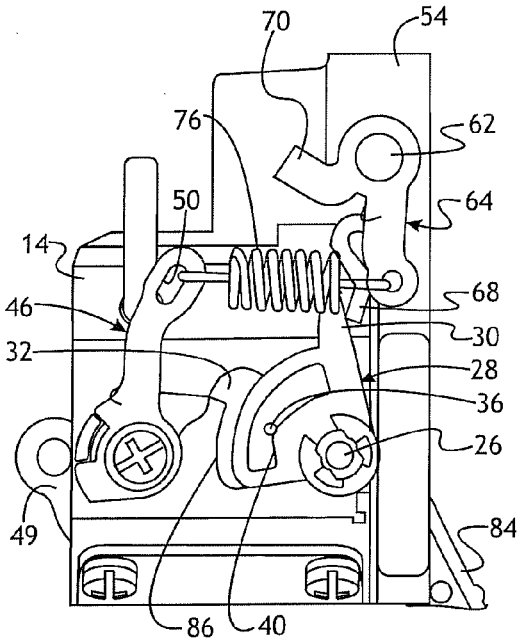
FIG. 5 is a side view of the carburetor showing the position of the throttle, choke and air valves when the choke valve has been rotated a first distance toward its closed position.
Figure 6B:
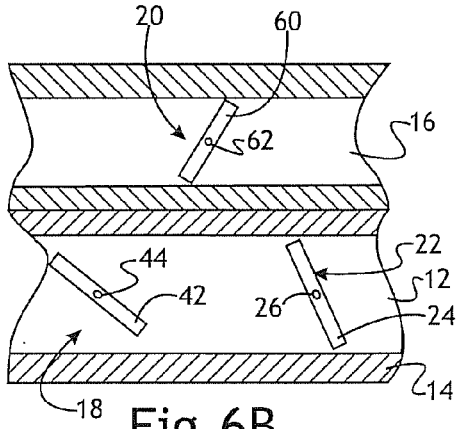
FIG. 6B is a diagrammatic view of an air passage and a fuel and air mixing passage, and the throttle, choke and air valves shown in the same position as in FIG. 6A.
Figure 6A:
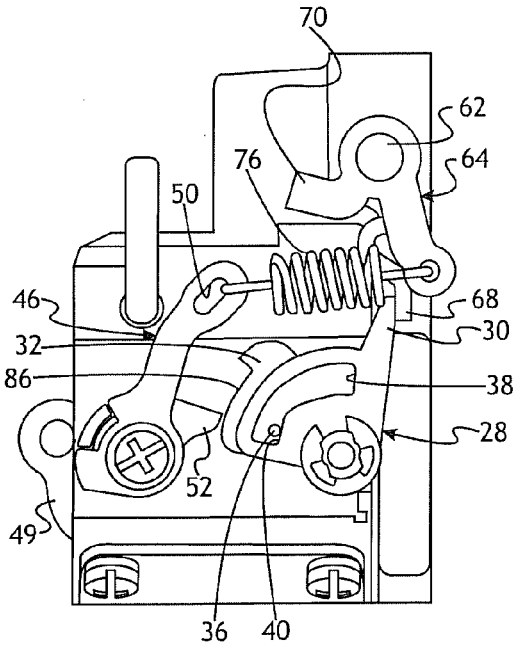
FIG. 6A is a side view of the carburetor showing the position of the throttle, choke and air valves with the choke valve shown in its closed position.

As shown in FIGS. 5 and 6, to perform a cold start of the engine, the choke valve 22 may be moved to its fully closed position, such as by manually rotating a choke activation link 84 connected to the choke valve shaft 26 from its first position (FIG. 1) to its second position (FIG. 5). This causes the first projection 30 to engage the tab 68 on the air valve link 64 and rotate the air valve 20 from its initial or start position toward or to its fully closed position. As the choke valve 22 is closed, the second projection 32 of the choke valve link 28 engages the second arm 52 of the throttle valve link 46 and rotates the throttle valve 18 away from its idle position to a start position. In the implementation shown, the second projection 32 may rotate the throttle valve 18 slightly past its start position (see FIG. 5) and after the second projection 32 is rotated past the second arm 52, the throttle valve 18 rotates slightly back to its start position which may be defined by engagement of the second arm 52 with a surface 86 of the choke valve link 28, as shown in FIG. 6A. In this position, the air valve 20 and choke valve 22 are closed, the throttle valve 18 is in its start position, and the engine may be started. The position of the valves 18, 20, 22 may be maintained by the position retention feature of the choke valve. That is, by engagement of the choke valve surface 40 with the pin 36.

Figure 7A:
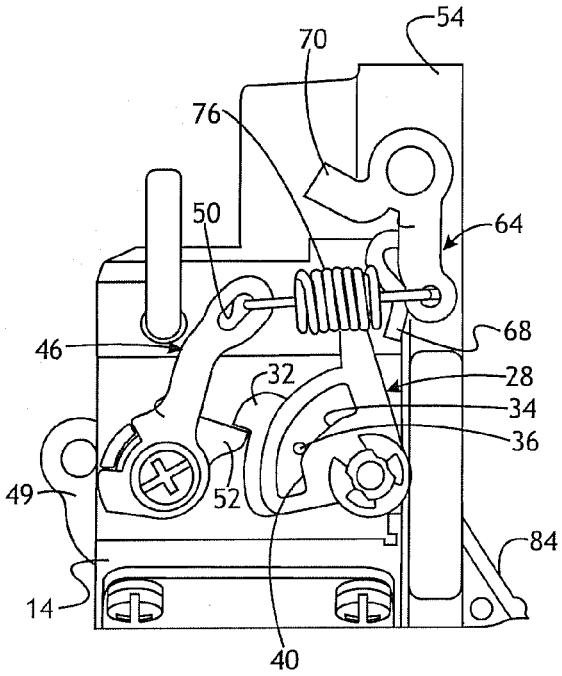
FIG. 7A is a side view of the carburetor showing the position of the throttle, choke and air valves when the choke valve is in an intermediate position.
Figure 7B:
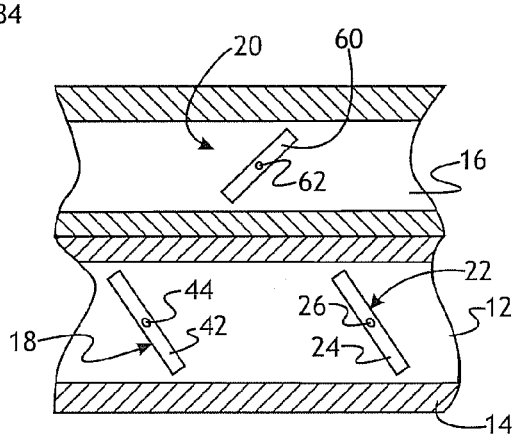
FIG. 7B is a diagrammatic view of an air passage and a fuel and air mixing passage, and the throttle, choke and air valves shown in the same position as in FIG. 7A.
Figure 8:
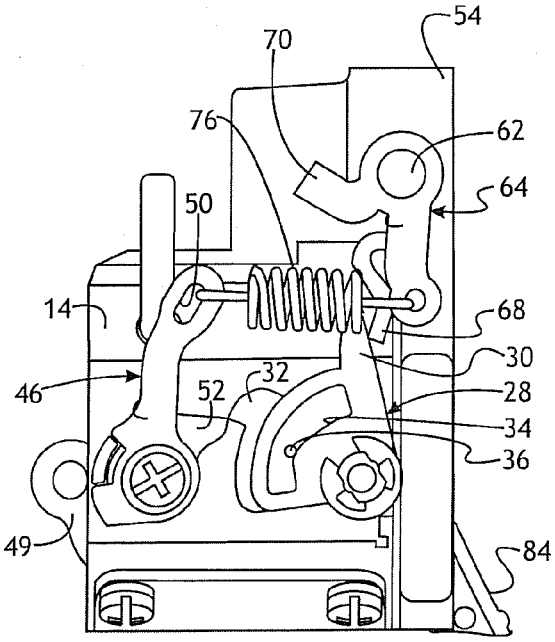
FIG. 8 is a side view of the carburetor showing the position of the throttle, choke and air valves when the throttle valve has been rotated a toward its wide open position from the position shown in FIGS. 7A and 7B.

After starting and initial warm-up of the engine (or otherwise, as desired), the choke valve 22 may be moved from its closed (e.g. full choke) position to a partial choke or intermediate position, as shown in FIG. 7. This position may be maintained by engagement of the second projection 32 of the choke valve link with the second arm 52 of the throttle valve link 46. In this position, the throttle valve 18 is maintained in its start position, the choke valve 22 is between its closed and open positions, and the air valve 20 may rotate slightly open from its start position under the force applied to the air valve link 64 by the connector 74. The engine may be further warmed-up under partial choke, as desired. After the engine is warmed-up, the operator may open the throttle valve 18 more thereby rotating the second arm 52 out of registry with the second projection 32 (as shown in FIG. 8) and thereby permitting the choke valve 22 to return to its open position. The throttle and air valves 18, 20 will now operate without interference from the choke valve 22 and in the manner previously described.

Figure 9:
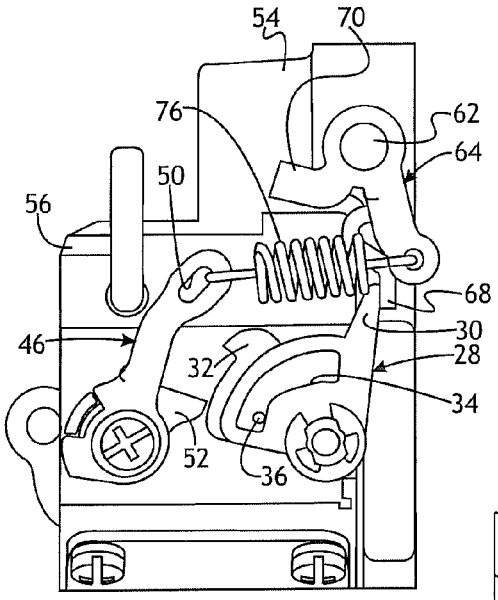
FIG. 9 is a side view of the carburetor showing the position of the throttle, choke and air valves with the choke valve shown in its closed position, like FIG. 6.
Figure 11:
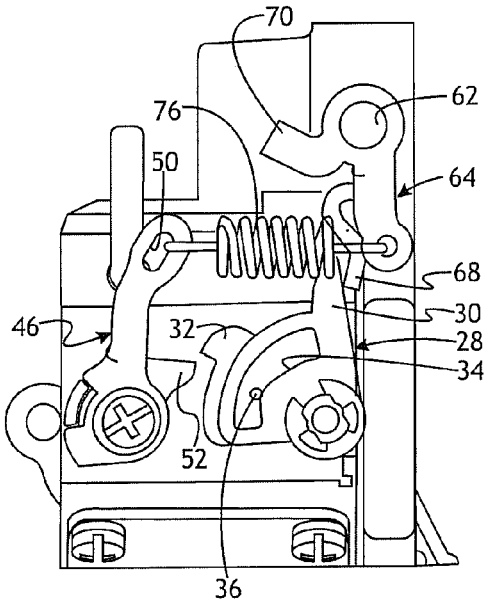
FIG. 11 is a side view of the carburetor showing the position of the throttle, choke and air valves when the throttle valve has been rotated toward its wide open position sufficiently to cause the limiter to engage and start moving the air valve.

FIGS. 9-11 illustrate another way in which the choke valve 22 may be moved from its closed position to its open position when desired. In FIG. 9, the choke valve 22 is shown in its closed position and the throttle and air valves 18, 20 are shown in their corresponding positions as discussed above with regard to FIG. 6. In this position, as shown in FIGS. 9 and 10, the choke valve 22 is maintained in its closed position by the pin 36, and the limiter 82 is not in contact with the tab 68 of the air valve link 64. As shown in FIGS. 11 and 12, as the throttle valve 18 is rotated toward its wide open position, the air valve 20 is held in place by the engagement of the tab 68 with the choke valve first projection 30 and the spring 76 stretches or extends to accommodate the throttle valve movement. When the spring 76 provides a force on the air valve 20 that is strong enough to overcome the force of the pin 36 on the choke valve 22, the choke valve 22 will be rotated off the pin 36, and then the choke valve 22 will return to its open position under the force of its return spring. Of course, the throttle valve 18 could rotate toward its wide open position until the limiter 82 engages the air valve tab 68. Thereafter, further rotation of the throttle valve 18 would cause the limiter 82 to rotate the air valve 20 and the choke valve 22 to move the choke valve 22 away from its closed position. With the choke valve 22 rotated off the pin 36 and the second projection 32 clear of the second arm 52 of the throttle valve link 46, the choke valve 22 is rotated back to its open position under the force of its return spring. Accordingly, the choke valve 22 may be moved from its closed position to its open position without having to manually move the choke actuation link 84.

Figure 13:
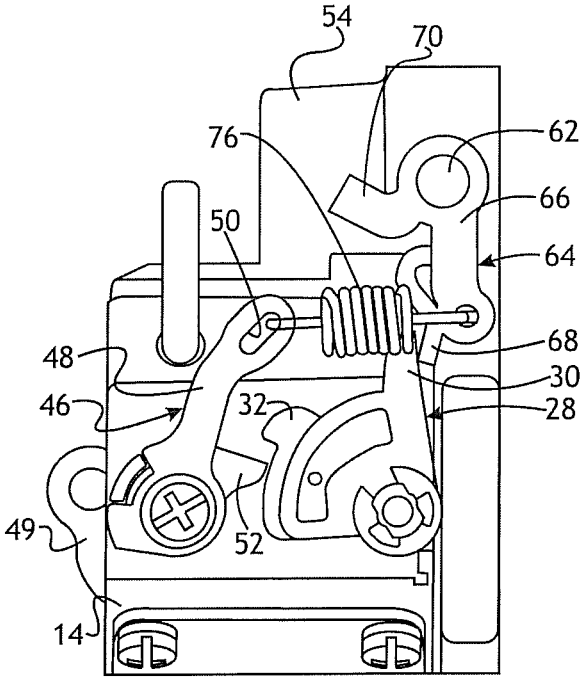
FIG. 13 is a side view of a carburetor with an automatically actuated choke valve showing the position of the throttle, choke and air valves with the choke valve shown rotated toward its closed position.
Figure 14:
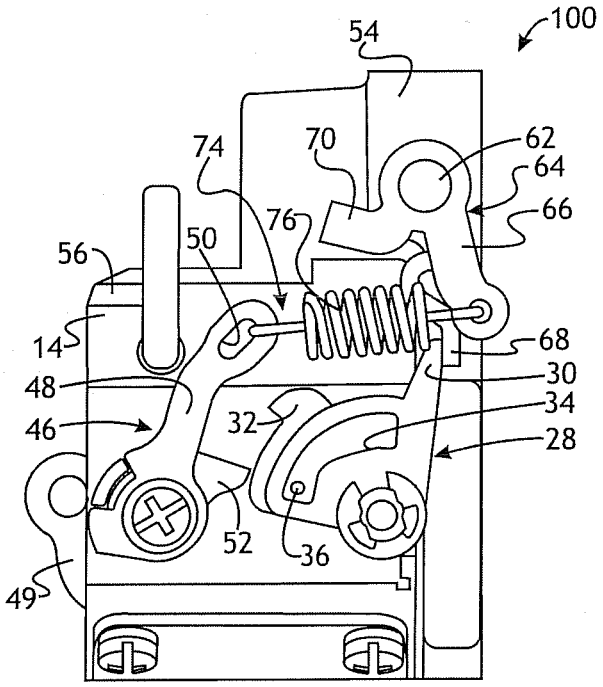
FIG. 14 is a side view of the carburetor of FIG. 13 showing the position of the throttle, choke and air valves with the choke valve shown in its closed position.
Figure 15:
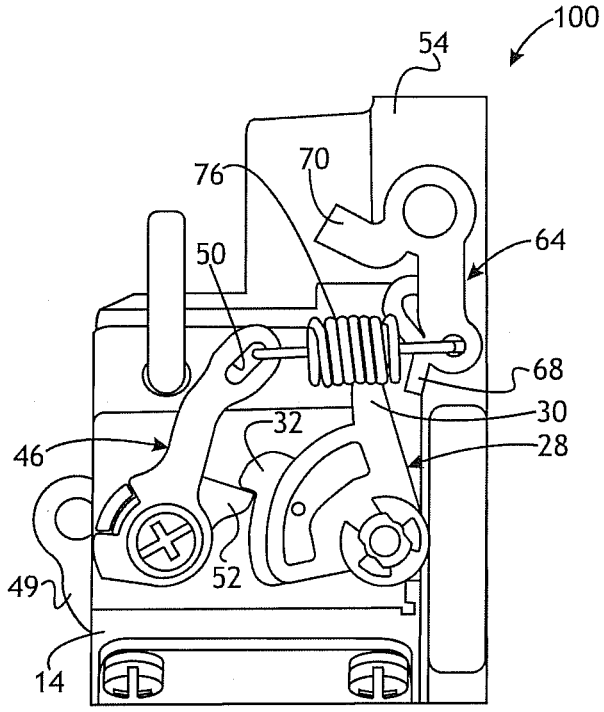
FIG. 15 is a side view of the carburetor of FIG. 13 showing the position of the throttle, choke and air valves with the choke valve shown in an intermediate position.

Instead of a manually activated choke valve 22, a carburetor 100 may also be used in a system wherein the choke valve 22 is automatically actuated during starting of the engine, or attempts to do so. An exemplary system is disclosed in U.S. Pat. No. 7,334,551 which is incorporated in its entirety by reference herein. Of course, other arrangements linking the choke valve 22 and a starting system may be used. An exemplary carburetor for use in such a system is shown in FIGS. 13-15. The throttle valve 18, air valve 20 and connector 74 may be identical to those components as shown and described with regard to the previous embodiment. The choke valve 22 may also be the same except no choke actuating link 84 is needed in this implementation. Because the relevant components in the implementation shown are the same, or very nearly so, as that already described, the explanation of the structure and arrangement of these components will not be repeated. Instead, the operation of the carburetor 100 during starting or an attempted start of an engine will be described.

As shown in FIGS. 13 and 14, as the engine is started (or during an attempt to start the engine), the choke valve 22 is rotated toward its closed position. As shown in FIG. 13, during that rotation, the choke valve first projection 30 initially engages the air valve link tab 68. Upon further movement of the choke valve 22 to its closed position, as shown in FIG. 14, the air valve 20 is moved to its fully closed position by the choke valve 22 as the choke valve is closed. This reduces the air flow to the engine as the engine is cranked to start it so that the fuel and air mixture delivered to the engine is not undesirably lean. During this rotation of the choke valve 22, the choke valve link 28 also engages the throttle valve link 46 and moves the throttle valve 18 to a start position, as discussed with regard to the embodiment with the manually activated choke valve. As shown in FIG. 15, after the force rotating the choke valve 22 as shown in FIGS. 13 and 14 is released, the choke valve 22 is rotated by its return spring back to an intermediate closed position wherein the second projection 32 engages the second arm 52 of the throttle link 46. In this position, the air valve 20 is rotated to a slightly open position by the force provided on the air valve 20 by the connector 74. As in the prior embodiment, activation of the throttle valve 22 will disengage the second arm 52 and second projection 32 and permit the choke valve 22 to return to its open position. Thereafter, the throttle valve 18 may be controlled by the operator and the air valve 20 will be driven by movement of the throttle valve 18 as previously described. Finally, the position retention feature (e.g. the pin 36) might only determine the open position of the choke valve 22, and it might not interfere with movement of or hold the choke valve 22 in other positions, like fully closed, as in the prior embodiment. Of course, there are many ways to limit movement of the choke valve 22 and/or define its open position, with or without the pin 36 or slot 34, and the manner shown is just one of those ways to do so.

While the forms of the invention herein disclosed constitute presently preferred embodiments, many others are possible. It is not intended herein to mention all the possible equivalent forms or ramifications of the invention. It is understood that the terms used herein are merely descriptive, rather than limiting, and that various changes may be made without departing from the spirit or scope of the invention.

The invention claimed is:

1. A carburetor, including:

an air passage and a fuel and air mixing passage;

a throttle valve disposed in communication with the fuel and air mixing passage and movable between an idle position and an open position permitting an at least somewhat less restricted fluid flow therethrough than when the throttle valve is in the idle position;

an air valve disposed in communication with the air passage, and movable between closed and fully open positions to control air flow through the air passage;

a lost motion coupler interconnecting the air valve and the throttle valve and constructed to provide a limited opening movement of the throttle valve away from its idle position without a corresponding opening movement of the air valve, and provide opening movement of the air valve along with further opening movement of the throttle valve after said limited movement of the throttle valve and until the air valve is fully open with the throttle valve only partially open, and to provide substantial further opening movement of the throttle valve to its wide open position after the air valve is fully open.

2. The carburetor of claim 1 wherein the lost motion coupler includes a connector coupled to the air valve and the throttle valve, and wherein the throttle valve includes a slot with which the connector is associated to permit movement of the throttle valve relative to the connector and the air valve during initial movement of the throttle valve away from its idle position.

3. The carburetor of claim 2 wherein the connector is flexible to permit movement of the throttle valve after the air valve is in its fully open position and further movement of the air valve is prevented.

4. The carburetor of claim 2 wherein the connector may be extended to permit the throttle valve to move relative to the air valve.

5. The carburetor of claim 4 wherein the connector includes a spring that is stretched at least during and by rotation of the throttle valve toward its wide open position after the air valve is fully open.

6. The carburetor of claim 1 wherein a stop is provided for the throttle valve to define the wide open position, and another stop is provided for the air valve to define the fully open position of the air valve.

7. The carburetor of claim 6 wherein the stop for the throttle valve is defined by a limiter that is connected to the air valve so that the air valve engages its stop no later than when the throttle valve reaches its stop.

8. The carburetor of claim 7 wherein the limiter limits the maximum amount the throttle valve may move toward its wide open position and relative to the air valve after the air valve is in its fully open position.

9. A carburetor, including:

an air passage and a fuel and air mixing passage;

a throttle valve disposed in communication with the fuel and air mixing passage and movable between an idle position and an open position permitting an at least somewhat less restricted fluid flow therethrough than when the throttle valve is in the idle position;

an air valve disposed in communication with the air passage, and movable between closed and fully open positions to control air flow through the air passage;

a lost motion coupler interconnecting the air valve and the throttle valve to permit a limited movement of the throttle valve away from its idle position without a corresponding movement of the air valve, and to permit movement of the air valve along with the throttle valve after said limited movement and until the air valve is fully open, and to permit further movement of the throttle valve to its wide open position after the air valve is fully open; and a choke valve disposed in communication with the fuel and air mixing passage and movable between an open position and a closed position, wherein the choke valve is operably associated with the air valve to move the air valve to its closed position when the choke valve is moved to its closed position.

10. The carburetor of claim 9 wherein the choke valve, throttle valve and air valve all include links, and the choke valve link engages the throttle valve link to rotate the throttle valve as the choke valve is rotated toward its closed position, and the choke valve link also engages the air valve link to rotate the air valve toward its closed position when the choke valve is rotated toward its closed position.

11. The carburetor of claim 10 wherein the air valve rotates in one direction from its closed to open positions and the throttle valve rotates in the opposite direction from its idle to its wide open positions.

12. The carburetor of claim 10 wherein the lost motion coupler interconnects the throttle valve link and the air valve link.

13. The carburetor of claim 12 wherein the throttle valve link includes a slot in the area of the connection between the throttle valve link and the lost motion coupler, and the slot permits movement of the throttle valve relative to the connector to permit movement of the throttle valve relative to the air valve during at least a portion of the range of movement of the throttle valve.

14. The carburetor of claim 10 wherein, when the choke valve is in its open position, the throttle valve can be rotated between its idle and wide open positions and the air valve can be rotated between its closed and fully open positions without the throttle valve link or the air valve link engaging the choke valve link.

15. A carburetor, including:

an air passage and a fuel and air mixing passage;

a throttle valve disposed in communication with the fuel and air mixing passage and movable between an idle position and an open position permitting an at least somewhat less restricted fluid flow therethrough than when the throttle valve is in the idle position;

an air valve disposed in communication with the air passage, and moveable movable between closed, rest and fully open positions to control air flow through the air passage, wherein the rest position of the air valve is between its closed and fully open positions;

a choke valve disposed in communication with the fuel and air mixing passage and movable between an open position and a closed position;

a lost motion coupler interconnecting the air valve and the throttle valve to permit limited relative movement between the throttle valve and the air valve, wherein the choke valve engages the air valve when the choke valve is moved to its closed position to move the air valve from its rest position to its fully closed position, and wherein the choke valve engages the throttle valve when the choke valve is moved to its closed position to move the throttle valve from its idle position toward its wide open position to facilitate starting an engine with which the carburetor is used, and the lost motion coupler permits the movements of the throttle valve and air valve.

16. The carburetor of claim 15 wherein the lost motion coupler includes a connector coupled to the air valve and the throttle valve, and the connector is extendable to permit the movement of the throttle valve and the air valve as the choke valve is moved to its closed position.

17. The carburetor of claim 16 wherein the connector includes a spring that is stretched during at least a portion of the movement of the air valve toward its closed position and the throttle valve away from its idle position.

18. The carburetor of claim 15 wherein the choke valve includes a position retention feature adapted to cooperate with another component to releasably hold the choke valve in its closed position, and in its closed position the choke valve engages the throttle valve and maintains the throttle valve in a position spaced from its idle position, and in its closed position the choke valve also engages the air valve to maintain the air valve in its closed position.

19. The carburetor of claim 15 wherein the choke valve is moved toward its closed position automatically during an attempted start of an engine with which the carburetor is used and the choke valve engages and rotates the throttle valve and the air valve as the choke valve is rotated toward its closed position.

20. The carburetor of claim 16 wherein the connector has an at-rest length that is less than the distance between the points of engagement of the connector with the throttle valve and the air valve when the throttle valve is in its wide open position and the air valve is in its fully open position, and the connector is extendable to permit the throttle valve to be in its wide open position when the air valve is in its fully open position.

21. The carburetor of claim 20 wherein a positive stop is provided for the air valve to define the fully open position of the air valve and prevent movement of the air valve beyond its fully open position, and wherein, after the air valve reaches its fully open position, the connector extends as the throttle valve is rotated further toward its wide open position.

22. The carburetor of claim 21 which also includes a limiter operably associated with the throttle valve and the air valve to limit the movement of the throttle valve after the air valve has engaged its stop and to thereby define the wide open position of the throttle valve.

* * * * *

UNITED STATES PATENT AND TRADEMARK OFFICE

CERTIFICATE OF CORRECTION

PATENT NO. : 8,453,998 B2
APPLICATION NO. : 12/858116
DATED : June 4, 2013
INVENTOR(S) : George M. Pattullo et al.

It is certified that error appears in the above-identified patent and that said Letters Patent is hereby corrected as shown below:

In the Claims

Column 11, Line 18, delete “moveable”.

Signed and Sealed this
Sixth Day of August, 2013

Teresa Stanek Rea
*Acting Director of the United States Patent and Trademark Office*